US005382883A

United States Patent [19]

Chen et al.

[11] Patent Number: 5,382,883

[45] Date of Patent: Jan. 17, 1995

[54] MULTI-BEAM GROUP ELECTRON GUN WITH COMMON LENS FOR COLOR CRT

[75] Inventors: Hsing-Yao Chen, Barrington, Ill.; Chun-Hsien Yeh, Taipei, Taiwan, Prov. of China

[73] Assignee: Chunghwa Picture Tubes, Ltd., Taoyuan, Taiwan, Prov. of China

[21] Appl. No.: 98,072

[22] Filed: Jul. 28, 1993

[51] Int. Cl.[6] ..... H01J 29/51

[52] U.S. Cl. ..... 315/368.15; 313/409

[58] Field of Search ..... 315/368.15; 313/409, 313/410, 411, 412

[56] References Cited

U.S. PATENT DOCUMENTS

| | | | |
|---|---|---|---|
| 3,448,316 | 6/1969 | Yoshida et al. | 313/69 |
| 3,651,359 | 3/1972 | Miyaoka | 313/70 |
| 3,943,281 | 3/1976 | Keller et al. | 313/409 |
| 4,361,781 | 11/1982 | Depp et al. | 313/409 |
| 4,500,808 | 2/1985 | McCandless | 313/409 |
| 4,604,547 | 8/1986 | Saito et al. | 313/413 |
| 4,616,160 | 10/1986 | Holtey et al. | 315/365 |
| 4,710,672 | 12/1987 | Van Tol | 313/413 |
| 4,853,601 | 8/1989 | Odenthal | 315/368 |

OTHER PUBLICATIONS

*The "Trinitron"–A New Color Tube,* Yoshida et al., Sony Corporation, Shinagawa, Tokyo, Japan, pp. 19–27, 1968.

*A Multibeam CRT,* D. L. Say, pp. 29–34, Information Display, May, 1970.

*Primary Examiner*—Theodore M. Blum

*Attorney, Agent, or Firm*—Emrich & Dithmar

[57] ABSTRACT

An inline electron gun for a color cathode ray tube (CRT) directs electron beams through an Einzel lens common to all of the beams for focusing the beams on a display screen across which the beams are scanned in horizontal scan lines in a raster-like manner. The electron gun includes a beam forming region (BFR) for forming the beams in a matrix array including a plurality of vertically spaced, horizontally aligned apertures, where each horizontally aligned group of apertures passes the primary color electron beams for one scan line on the display screen and vertically aligned apertures are grouped to pass common color electron beams which are horizontally deflected in synchronism over adjacent, vertically spaced scan lines on the display screen. All of the electron beams converge and cross over the electron gun's axis at the center of the Einzel lens, with the diverging beams then directed through a convergence arrangement which converges each group of the horizontally aligned beams to a common spot on a given scan line permitting video display information to be presented simultaneously on more than one scan line. The beam convergence arrangement equalizes the vertical and horizontal convergence effects on each of the beams in the matrix array of beams to deflect the outer beams inwardly while deflecting the upper and lower beams respectively downwardly and upwardly so that each group of horizontally aligned beams converge on the center beam of that group at the display screen.

27 Claims, 6 Drawing Sheets

$V_1$ & $V_2 > V_3$ $V_1 > V_2$

MULTI-BEAM GROUP ELECTRON GUN WITH COMMON LENS FOR COLOR CRT

FIELD OF THE INVENTION

This invention relates generally to cathode ray tubes (CRTs) of the single electron gun, plural beam type and is particularly directed to an electron gun having a common lens for a plurality of grouped electron beams for simultaneously providing video information on more than one horizontal scan line with each CRT display screen sweep.

BACKGROUND OF THE INVENTION

Color cathode ray tubes (CRTs) generally employ either a single electron gun or plural electron guns for directing and focusing multiple electron beams on the CRT's display screen. In the plural gun design, each electron beam is formed, accelerated and focused by an individual set of charged grids in common alignment. In the single gun approach, all of the electron beams pass substantially through the optical center of a common electron lens which focuses the beams on the CRT's display screen.

Referring to FIG. 1, there is shown a simplified perspective view of a multi-beam electron gun 20 with a common lens for forming, accelerating and focusing three electron beams 22*a*, 22*b* and 22*c* on the display screen 26 of a CRT. Only a portion of display screen 26 and only the neck portion 21 of a CRT is shown for simplicity. Each of the three electron beams 22*a*, 22*b* and 22*c* provides a respective one of the three primary colors of red, green and blue for the video image. Electron gun 20 includes a pre-focused lens 32 adapted to receive respective pluralities of energetic electrons emitted by three inline cathodes 30*a*, 30*b* and 30*c*. The three cathodes 30*a*, 30*b* and 30*c* are typically in horizontal alignment, with each of the three energetic groups of electrons first directed through a respective aperture in a $G_1$ control grid and thence through a respective aperture 40*a*, 40*b* and 40*c* in a generally flat end wall 40 of a $G_2$ screen grid of the pre-focus lens 32 in forming the three electron beams 22*a*, 22*b* and 22*c*. As the three electron beams 22*a*, 22*b* and 22*c* transit a main focus lens 34, which is of the Einzel type, the two outer electron beams 22*a* and 22*c* are deflected inwardly so that the beams pass through a beam crossover 36 located on the longitudinal axis of the electron gun 20 shown in dotted line form as A—A' in the figure. Main focus lens 34 includes charged $G_3$, $G_4$ and $G_5$ grids aligned along axis A—A'. After the beam crossover 36, the three electron beams 22*a*, 22*b* and 22*c* are directed through a beam deflector 38 which again bends the two outer beams towards the electron gun axis A—A' so that all three electron beams intercept the CRT's faceplate 26 at a common point, or spot, 46. Beam deflector 38 is comprised of a pair of vertically aligned, horizontally spaced plates 42 and 44 for applying a convergence electrostatic field on the two outer beams 22*a* and 22*c*. The three electron beams 22*a*, 22*b* and 22*c* sequentially transit a plurality of elongated, vertically aligned shadow mask apertures 28 and are incident upon a plurality of phosphor elements 24 as they are deflected over display screen 26 by means of a magnetic deflection yoke which is not shown in the figure for simplicity.

While the conventional multi-beam electron gun 20 with a common lens of FIG. 1 has been an accepted standard in CRTs for many years, the clear path for future color CRT development is in the direction of high definition television (HDTV) displays. This is true whether operating in accordance with the NTSC standard or the PAL format. Regardless of the color television system, an HDTV display requires a higher frequency magnetic deflection yoke and high video image resolution and brightness.

Increasing the scan frequency of the CRT's magnetic deflection yoke requires higher deflection input power to the yoke as well as a more expensive yoke assembly. To provide acceptable brightness and resolution in a large 16:9 color CRT, higher beam current and improved video image resolution are required. These enhancements typically require a larger CRT envelope neck size to accommodate a larger electron gun. Increasing the size of the CRT envelope is contrary to current trends which seek to reduce the non-display screen portions of the CRT. One approach to providing acceptable image brightness involving the use of higher beam currents employs a dispenser cathode which affords high electron emission densities. However, the use of a dispenser cathode substantially increases the cost of the cathode, i.e., on the order of 20–50 times more than that of a conventional oxide cathode, to the point where these cathodes are at present not economically viable for use in a conventional CRT. While some of the aforementioned approaches have been adopted in HDTV CRTs, the increased cost and complexity of the resulting CRT reduces its commercial competitiveness relative to other HDTV display technologies such as liquid crystal displays (LCDs), plasma display panels (PDPs), etc.

The present invention addresses the aforementioned limitations of the prior art by providing a multi-beam group (MBG) single electron gun having a common lens for all of the electron beams for use in a color CRT wherein two or more vertically spaced, horizontal inline electron beam arrays provide the primary colors of red, green and blue to adjacent horizontal scan lines on the CRT display screen permitting two or more adjacent lines of the video image to be simultaneously formed on the display screen.

OBJECTS AND SUMMARY OF THE INVENTION

Accordingly, it is an object of the present invention to provide a multi-beam, common lens electron gun for a color CRT wherein the beams are arranged in a matrix array to allow for the simultaneous presentation of video information on more than one horizontal scan line on the CRT's display screen.

It is another object of the present invention to increase pixel dwell time in a multi-beam color CRT by simultaneously directing plural electron beams on adjacent horizontal scan lines of the CRT's display screen to allow for a reduction in horizontal scan frequency and peak beam current without sacrificing video image brightness while improving video image resolution.

Yet another object of the present invention is to provide a brighter and higher resolution video image on the display screen of a color CRT without increasing cathode current density or magnetic deflection yoke operating frequency.

A further object of the present invention is to horizontally deflect at least two sets of outer electron beams inwardly so that each set of outer beams converges on a respective center beam to provide video image information simultaneously on adjacent horizontal scan lines in a color CRT.

A still further object of the present invention is to apply an equalized electrostatic convergence field to a two-dimensional matrix array of electron beams to form a plurality of vertically aligned beam groups on the faceplate of a color CRT, with each group including beams for a respective one of the primary colors of red, green or blue and each beam group deflected in unison across a respective horizontal scan line in a raster-like manner.

A further object of the present invention is to store received color video image information for subsequent recall and display on a first horizontal scan line simultaneous with the display of additional stored video image information on a second adjacent scan line to increase the portion of the video image displayed with each horizontal scan of the CRT screen.

These objects of the present invention are achieved and the disadvantages of the prior art are eliminated by an electron gun for a multi-beam color cathode ray tube (CRT) including a display screen whereon a video image is formed by sweeping a plurality of horizontally aligned electron beams over a plurality of vertically spaced, horizontal scan lines in a raster-like manner, wherein each electron beam provides one of the three primary colors of red, green or blue of the video image, the electron gun including a high voltage common focus lens for focusing the electron beams on said display screen, the electron gun comprising: a cathode arrangement for providing energetic electrons; a beam forming arrangement disposed intermediate the cathode arrangement and the common focus lens for forming the energetic electrons into a plurality of beams, the beam forming arrangement including first and second spaced, charged grids respectively having first and second arrays of spaced apertures for forming the energetic electrons into a plurality of beams, wherein each of the first and second arrays of apertures include upper and lower horizontally aligned apertures for passing horizontally aligned electron beams providing the three primary colors of red, green and blue for upper and lower horizontal scan lines, respectively, and wherein the apertures in the first and second arrays are further grouped in vertical alignment so as to form vertically grouped electron beams with the electron beams in each vertical group providing one of the primary colors on a respective horizontal scan line; and a convergence arrangement disposed intermediate the common focus lens and the display screen for converging the electron beams into an upper and a lower spot on the display screen, wherein the upper and lower spots are swept over adjacent upper and lower horizontal scan lines, respectively.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like .reference characters identify like elements throughout the various figures, in which;

DETAILED DESCRIPTION OF THE PREFERRED EMBODIMENTS

Figure 1:
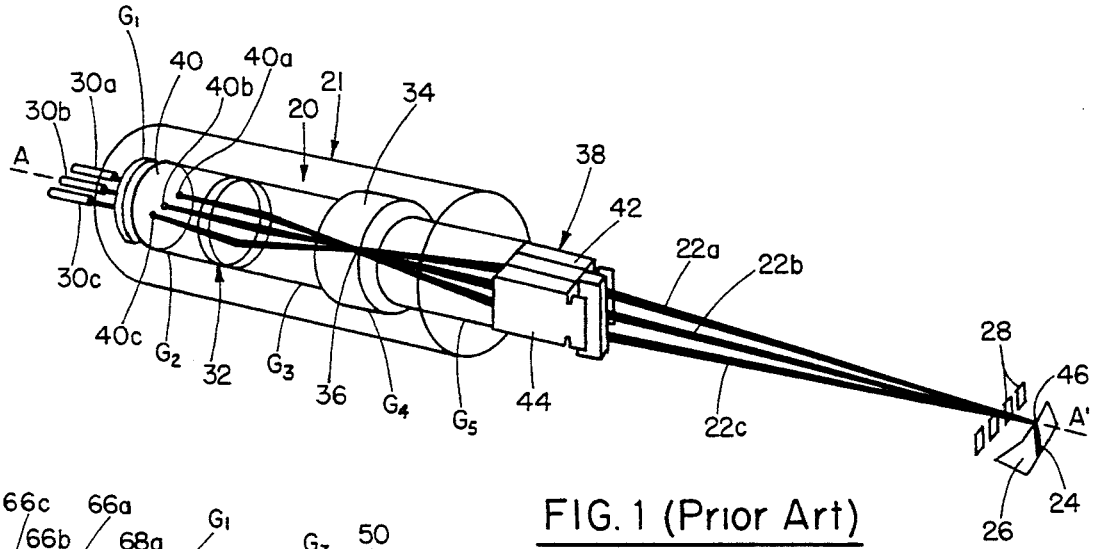
FIG. 1 (Prior Art)
FIG. 1 is a simplified perspective view of a prior art multi-beam electron gun having a common focus lens.
Figure 2:
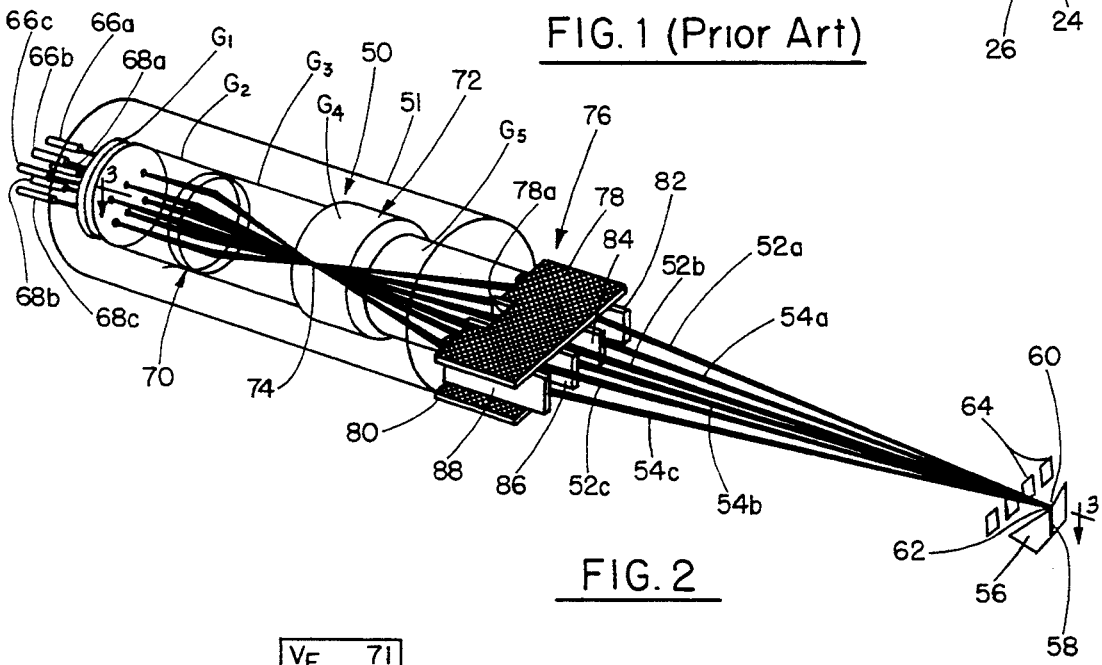
FIG. 2 is a simplified perspective view of a two-beam group electron gun with a common lens for a color CRT in accordance with the present invention.
Figure 3:
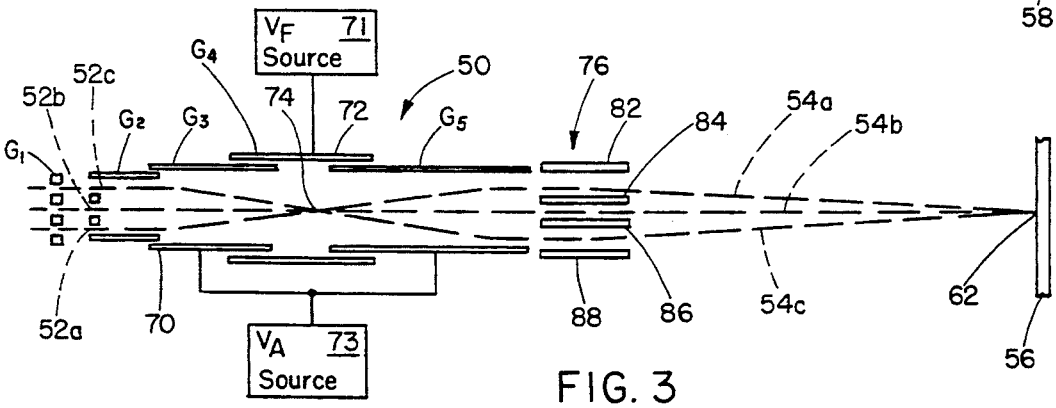
FIG. 3 is a longitudinal horizontal sectional view of the two-beam group electron gun of FIG. 2 taken along site line 3—3 therein.
Figure 12:
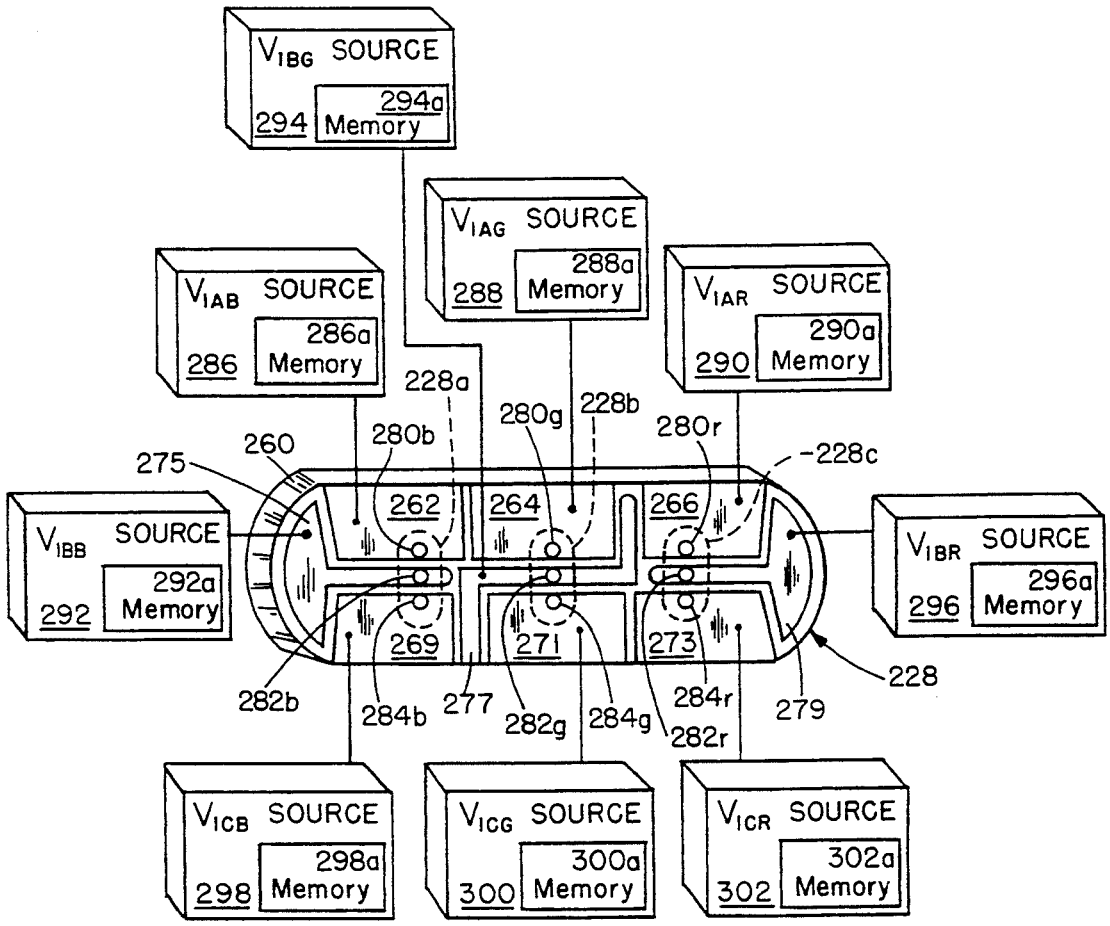
FIG. 12 is a perspective view of the $G_1$ control grid of the electron gun shown in FIGS. 8 and 9 also illustrating in simplified block diagram form video signal drivers coupled to the $G_1$ control grid.

Referring to FIG. 2, there is shown a simplified perspective view of a two-beam group electron gun 50 with a common lens in accordance with the principles of the present invention. FIG. 3 is a longitudinal horizontal sectional view of the two-beam group electron gun 50 of FIG. 2 taken along site line 3—3 therein. The electron gun 50 is disposed in the cylindrical neck portion 51 of the glass envelope of a CRT. The CRT further includes a display screen 56, only a portion of which is shown in the figure for simplicity. Electron gun 50 includes a plurality of cathodes including three inline upper cathodes, *66a*, *66b* and *66c* and three inline lower cathodes *68a*, *68b* and *68c*. Each of the aforementioned cathodes when heated emits energetic electrons in the direction of an apertured $G_1$ control grid. Each group of energetic electrons emitted by each of the cathodes is directed through a respective aperture in the $G_1$ control grid and thence through a respective aperture in a $G_2$ screen grid. The $G_1$ grid is generally planar having six spaced apertures arranged in a matrix array and respective conductive portions disposed about each aperture as described below and as shown in the embodiment of FIG. 12. The $G_2$ grid is generally cup-shaped having a flat end portion in facing relation to the $G_1$ grid. As shown in FIG. 2, the flat end portion of the $G_2$ grid includes six apertures also arranged in a matrix array, where each of the apertures is aligned with a respective aperture in the $G_1$ grid. The $G_1$ grid, $G_2$ grid and a facing portion of a $G_3$ grid form a pre-focus lens 70 of electron gun 50. Six electron beams 52*a*, 52*b*, 52*c* and 54*a*, 54*b*, and 54*c* are thus directed into pre-focus lens 70, with the outer electron beams deflected inwardly and the upper and lower electron beams respectively deflected downwardly and upwardly so that all beams transit a beam crossover 74 at the center of a main focus lens 72 of electron gun 50. Main focus lens 72 includes the combination of a $G_4$ and a $G_5$ grid. In the embodiment shown in FIGS. 2 and 3, the two-beam electron gun 50 is of the Einzel type wherein the $G_3$ and $G_5$ grids are coupled to an accelerating voltage ($V_A$) source 73 and the $G_4$ grid is coupled to and charged by a focus voltage ($V_F$) source 71 as shown in the longitudinal sectional view of the electron gun of FIG. 2 taken along site line 3—3 therein.

As shown in FIG. 3, the three upper apertures of the $G_1$ grid are aligned with respective upper apertures in the $G_2$ grid for forming the three upper electron beams. Similarly, a lower horizontal array of apertures in the $G_1$ grid is aligned with corresponding lower apertures in the $G_2$ grid for forming the three lower electron beams. As the six electron beams transit the pre-focus lens 70, the upper three electron beams are deflected downwardly and the lower three electron beams are deflected upwardly. Similarly, the four outer electron beams are each deflected inwardly so that all six electron beams transit the aforementioned beam crossover 74 at the center of the main focus lens 72. The upper electron beams in the prefocus lens 70 thus become the lower electron beams incident upon the CRT's display screen 56. Similarly, the outer electron beams are deflected inwardly, reversing their relative positions as they transit the beam crossover 74 so that the left hand beams in the pre-focus lens 70 become the right hand beams in the main focus lens 72, and vice versa. The various charged grids in the electron gun 50 accelerate the electron beams toward and focus the electron beams on the CRT's display screen 56, thus the $V_F$ and $V_A$ sources 71 and 73 are coupled to various of the grids in the electron gun. The $G_1$ grid is typically maintained at or about ground potential. The grid arrangement in electron gun 50 serves as a,common lens for all six electron beams as they travel toward the CRT's display screen 56. As in the prior art, disposed on the inner surface of the CRT's display screen 56 are a plurality of vertically elongated, horizontally spaced phosphor layers 58 upon which the electron beams are incident after passing through vertically elongated, horizontally spaced apertures 64 in the CRT's charged shadow mask which serves as a color selection electrode.

Disposed intermediate the main focus lens 72 and the CRT's display screen 56 is a beam convergence deflector 76. Beam convergence deflector 76 includes vertically spaced, horizontally aligned and parallel upper and lower deflector plates 78 and 80. Each of the upper and lower deflector plates 78, 80 includes a respective cut-out slot, or notch, on an aft edge, or in facing relation to the main focus lens 72 as shown for the case of cut-out slot 78*a* in the upper deflector plate. All of the electron beams pass intermediate the upper and lower deflector plates 78 and 80. Electron beams 52*a* and 54*a* pass intermediate a first outer deflector plate 82 and a first inner deflector plate 84, while outer electron beams 52C and 54C pass intermediate a second outer deflector plate 88 and a second inner deflector plate 86. The two center electron beams 52*b* and 54*b* pass intermediate the first and second inner deflector plates 84 and 86. In accordance with the present invention, the upper three electron beams 52*a*, 52*b* and 52*c* are converged and form an upper beam spot 60 on the CRT's faceplate 56. Similarly, the three lower electron beams 54*a*, 54*b* and 54*c* are converged and form a lower beam spot 62 on the CRT's display screen 56.

Figure 4:
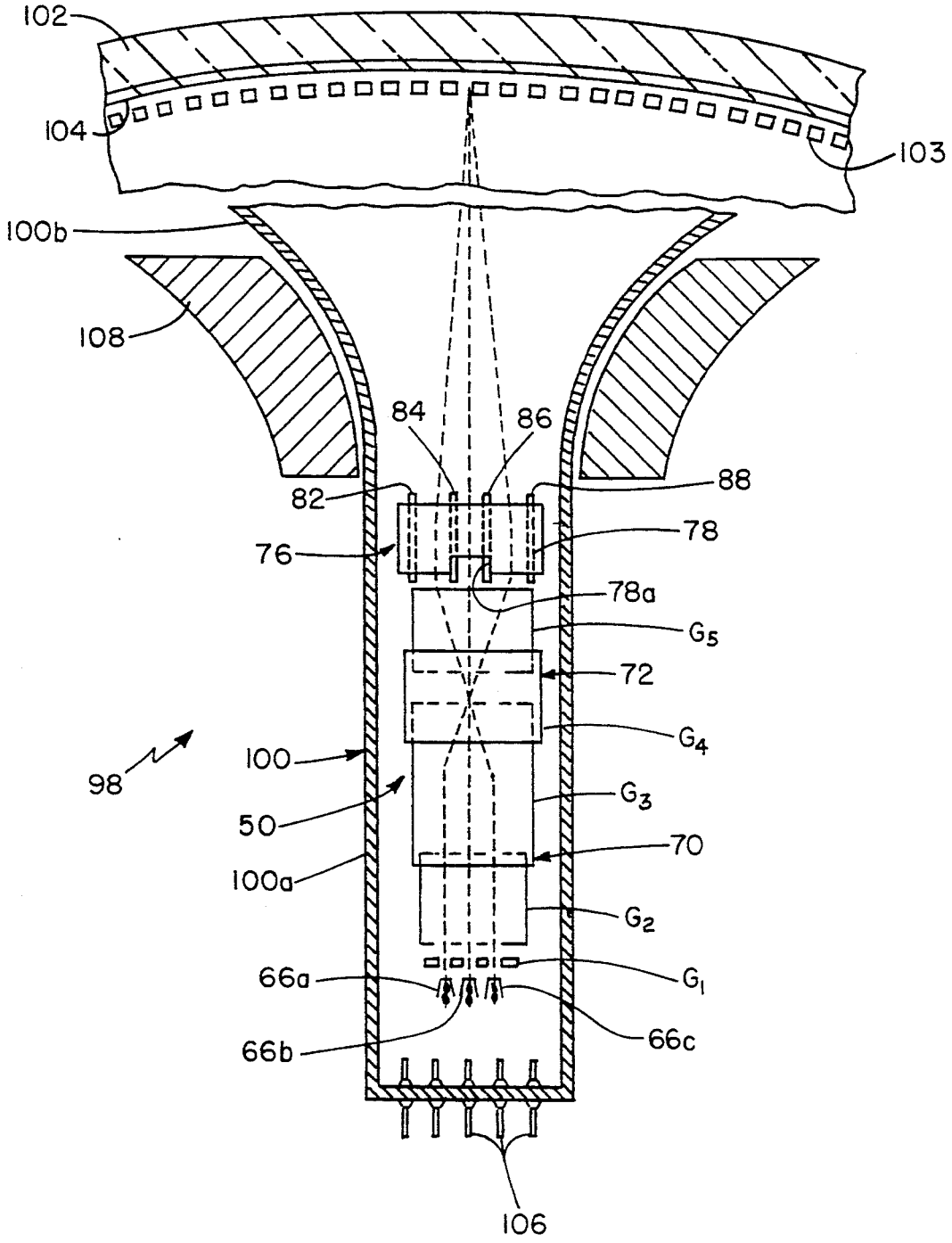
FIG. 4 is a partial longitudinal horizontal sectional view of a CRT incorporating a two-beam group electron gun having a beam deflector shown in section in accordance with the present invention.

Referring to FIG. 4, there is shown a simplified sectional view of electron gun 50 in a color CRT 98. CRT 98 includes a glass envelope 100 including a cylindrical neck portion 100*a* and a frusto-conical funnel portion 100*b*, with a glass display screen 102 attached to the enlarged, open end of the funnel portion by conventional means such as a glass frit (not shown). Disposed on the inner surface of the display screen 102 is a phosphor layer 104 containing three types of phosphor elements for each of the primary colors of red, green and blue. Disposed adjacent to the inner surface of the display screen 102 is a charged, apertured metal shadow mask 103 which functions as a color selection electrode. A magnetic deflection yoke 108 disposed about the CRT's funnel portion 100*b* provides for the deflection of the electron beams across display screen 102 in a raster-like manner. A plurality of connector pins 106 disposed on and inserted through the end of the CRT's neck portion 100*a* allow for various voltages and signals to be provided to the various charged grids in electron gun 50 and charged plates in beam convergence deflector 76.

Beam convergence deflector 76 is shown in a top plan view in FIG. 4. The four vertically aligned deflector plates 82, 84, 80, 86 and 88 are arranged in a spaced manner to permit transit of the electron beams through the beam convergence deflector 76. Although the cut-out slot 78*a* in the upper deflector plate 78 is shown as generally rectangular, the slot is not limited to this shape and may assume virtually any configuration provided that the slots in .the upper and lower deflector plates 78 and 80 equalize the electrostatic vertical convergence fields for the two center and four outer electron beams as described below. Furthermore, the arrangement for equalizing the electrostatic vertical convergence fields may be in a form other than slots in adjacent edges of the upper and lower deflector plates 78 and 80. For example, the upper and lower deflector plates 78 and 80 may be provided with respective apertures in an inner portion of the plate or respective recessed portions extending away from the inner electron beams which operate to equalize the electrostatic vertical convergence fields for the center and outer electron beams.

Figure 5:
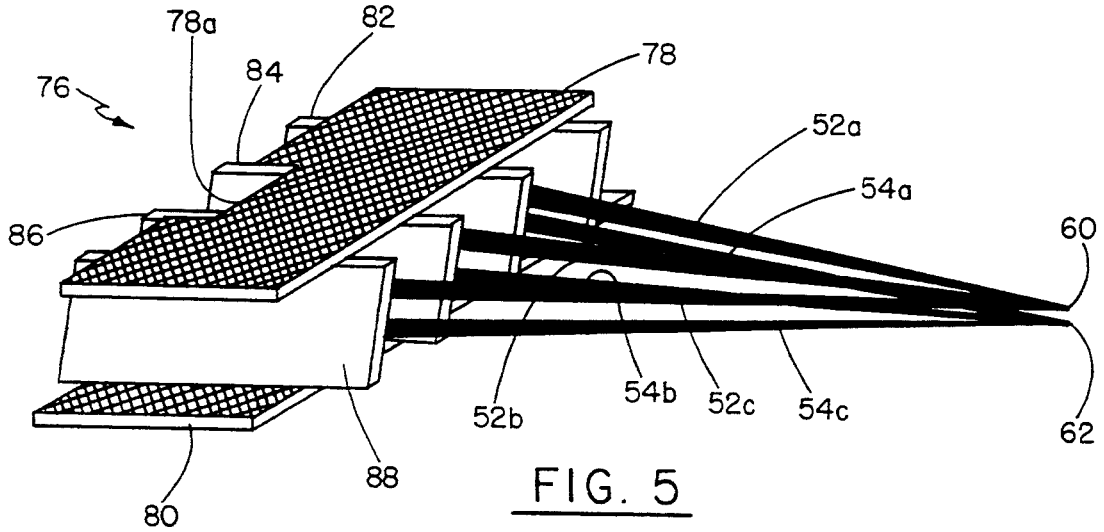
FIG. 5 is a perspective view of a beam deflector and electron beams passing therethrough employed in a two-beam group electron gun in accordance with the present invention.
Figure 6:
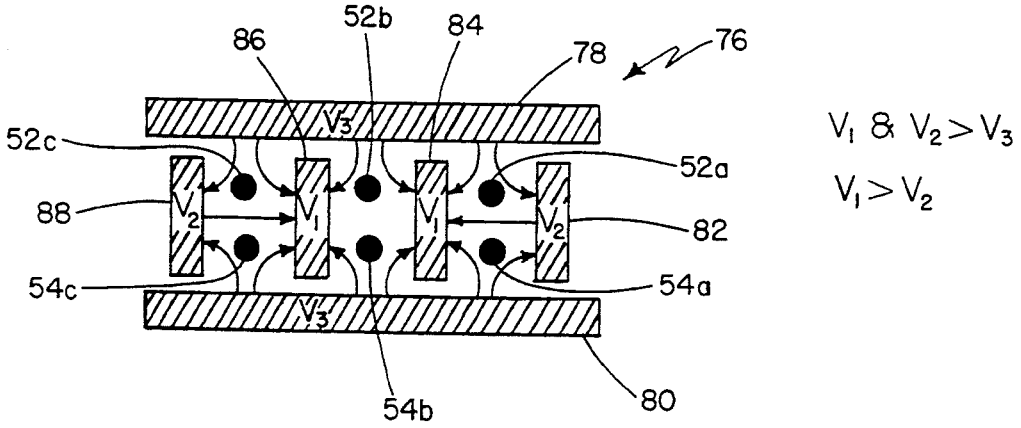
FIG. 6 is a transverse cross-sectional view of a beam convergence deflector used in the two-beam group electron gun of the present invention.
Figure 7:
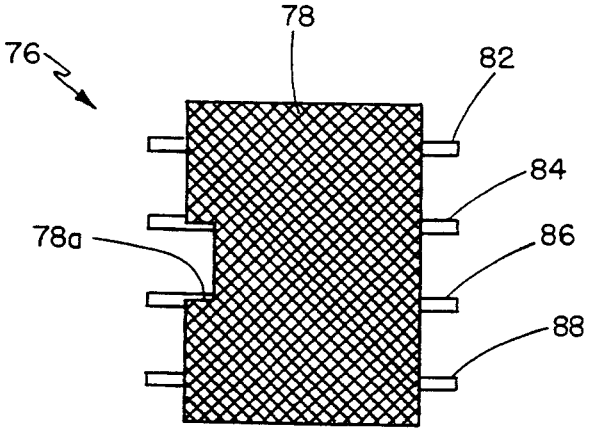
FIG. 7 is a top view of the beam convergence deflector shown in FIG. 6.

Referring to FIG. 5, there is shown a perspective view of beam convergence deflector 76 with six electron beams passing through the deflector. A front view of beam convergence deflector 76 with three upper electron beams 52*a*, 52*b* and 52*c* and three lower electron beams 54*a*, 54*b* and 54*c* passing through the beam convergence deflector is shown in FIG. 6. A top plan view of the beam convergence deflector is shown in FIG. 7. All six electron beams pass intermediate the upper and lower deflector plates 78 and 80. In addition, a first pair of outer electron beams 52*c* and 54*c* pass intermediate the second inner and outer deflector plates 86 and 88, while a second pair of outer electron beams 52*a* and 54*a* pass intermediate the first outer and inner deflector plates 82 and 84. The center two electron beams 52*b*, 54*b*, pass intermediate the two inner deflector plates 84 and 86. Edges of the upper and lower deflector plates 78, 80 in facing relation with the cathode are each provided with a respective cut-out slot as shown for the case of the upper deflector plate having slot 78*a* in the figures. The slots in each of the upper and lower deflector plates 78, 80 equalize the vertical electrostatic convergence fields for the inner and outer electron beams so that the three upper electron beams converge on a single, upper electron beam spot 60, while the three lower electron beams converge on a single lower electron beam spot 62 on the CRT's display screen.

All six electron beams are simultaneously deflected across the CRT's display screen by means of the magnetic deflection yoke 108 described above and shown in FIG. 4 to simultaneously provide video image information on two adjacent horizontal scan lines. When the upper and lower trios of electron beams reach a lateral edge of the display screen, they are quickly deflected to the opposed lateral edge to begin tracing the next two scan lines on the display screen. This scanning and retrace sequence continues until the upper and lower trios of electron beams scan the last two, or the bottom, horizontal scan lines on the display screen. Upon completion of scanning the bottom two scan lines on the display screen, the upper and lower trios of electron beams undergo retrace by means of the magnetic deflection yoke and are positioned to initiate scanning of the first two scan lines at the top of the display screen. By simultaneously tracing two or more horizontal scan lines, electron beam scan frequency and deflection frequency rate may be reduced and deflection yoke power requirements may be relaxed. This also allows for the use of a simpler, cheaper magnetic deflection yoke. The reduction in beam scan frequency gives rise to a corresponding increase in "dwell time" of the electron beams on the display screen's phosphor elements. Increasing electron beam dwell time allows for a corresponding reduction in electron beam peak current density giving rise to a corresponding improvement in electron beam spot size and video image resolution without sacrificing video image brightness.

The direction of the electrostatic convergence field exerted by the various charged plates of the beam convergence deflector 76 on the six electron beams is shown by the various arrows between adjacent plates in the deflector. In the beam convergence deflector 76, the upper and lower deflector plates 78, 80 are maintained at a voltage $V_3$, while the two inner deflector plates 84 and 86 are maintained at a voltage $V_1$ and the two outer plates 82, 88 are maintained at a voltage $V_2$. In the beam convergence deflector 76, $V_1>V_2$, and both $V_1$ and $V_2>V_3$. In general, the direction of the electrostatic field in deflecting an electron beam is from the plate having a lower voltage toward the plate having a higher voltage. Thus, the upper and lower trio of beams are deflected toward each other so as to accommodate the close spacing of adjacent scan lines on the CRT's display screen. In addition, the two pairs of outer electron beams are deflected inwardly toward the two inner deflector plates 84, 86 because $V_1>V_2$. The two inner electron beams 52*b* and 54*b* are not deflected horizontally because of the equal charge on the two inner deflector plates 84, 86 of $V_1$. However, the two inner electron beams 52*b* and 54*b* as well as the upper and lower outer electron beams are deflected toward each other because $V_1$ and $V_2>V_3$. The vertical convergence effect on the two inner electron beams 52*b* and 54*b* is greater than the vertical convergence effect on the four outer electron beams because the two inner electron beams transit through an inner region with a voltage difference of $V_1$ to $V_3$ which is greater than the average voltage difference in the two outer regions through which the outer electron beams pass which may be expressed as $V_1+V_2/2$ to $V_3$. In order to equalize the vertical convergence field applied to all six electron beams so as to form two vertically spaced electron beam spots on the CRT's display screen, the upper and lower deflector plates 78 and 80 are provided with respective cut-out slots to reduce the convergence effect on the two inner electron beams 52*b* and 54*b*. The cut-out slots in the aft edges of each of the upper and lower deflector plates 78, 80 reduces the vertical electrostatic force on the two inner electron beams 52*b* and 54*b* so that the deflection force exerted on the two inner electron beams is the same as the vertical deflection force exerted on the four outer electron beams. This beam deflection arrangement provides the two vertically spaced electron beam spots 60 and 62 on the CRT's display screen.

Although not shown in the figures, the charged plates of the beam convergence deflector 76 may be securely positioned within the CRT by conventional means such as glass rods which are used for maintaining the various charged grids of the electron gun in position. In addition, suitable insulators (also not shown) may be disposed between and connect adjacent plates of the beam convergence deflector 76 to provide a high strength, rigid beam convergence deflector structure.

Figure 8:
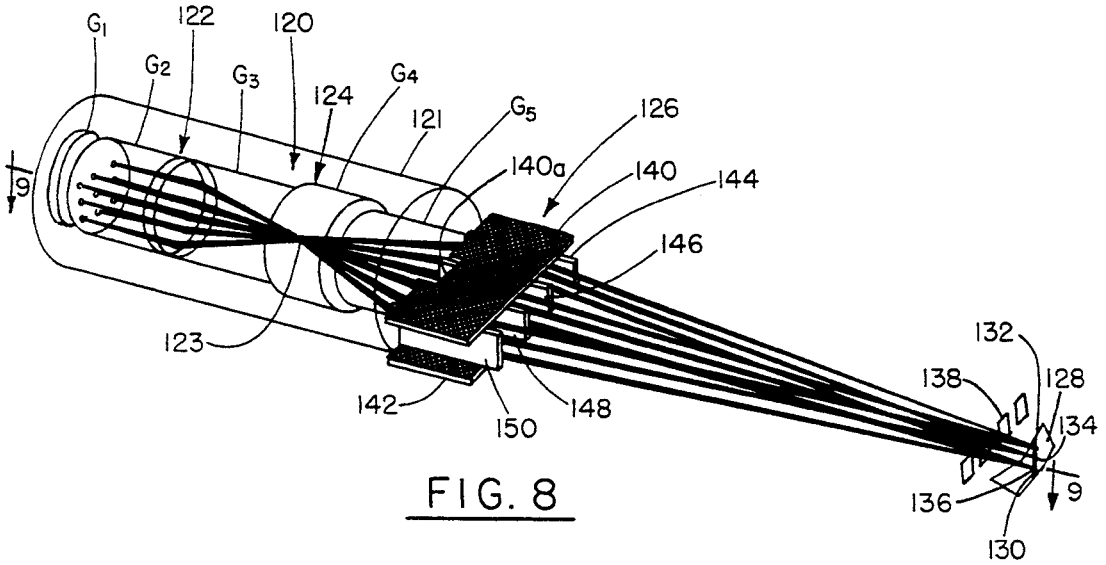
FIG. 8 is a simplified perspective view of another embodiment of a three-beam group electron gun in accordance with the present invention.
Figure 9:
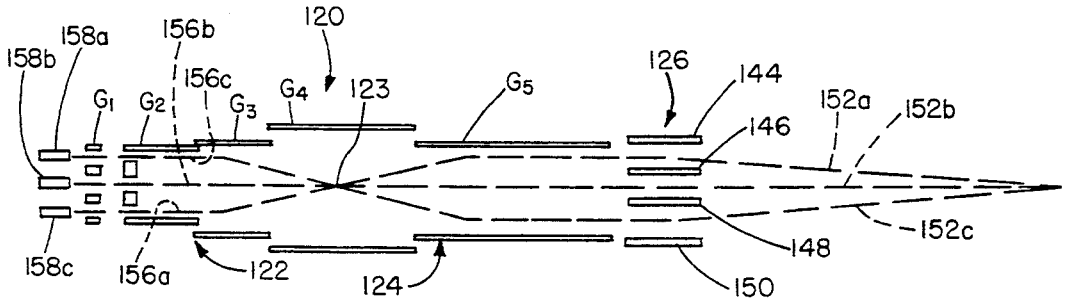
FIG. 9 is a longitudinal horizontal sectional view of the three-beam group electron gun shown in FIG. 8 taken along site line 9—9 therein.
Figure 10:
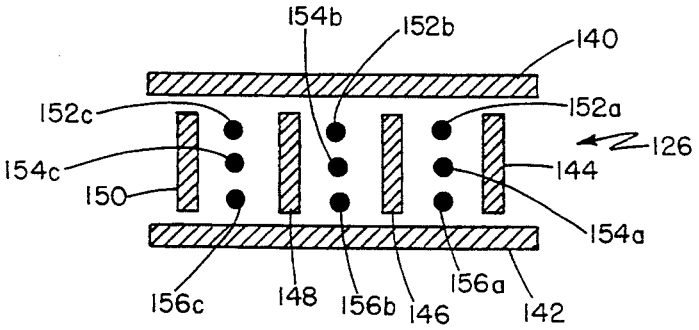
FIG. 10 is a transverse sectional view of the beam deflector employed in the three-beam group electron gun of FIG. 8.

Referring to FIG. 8, there is shown another embodiment of a three-beam group electron gun 120 having a common lens in accordance with the present invention. FIG. 9 is a horizontal transverse sectional view of the electron gun of FIG. 8 taken along site line 9—9 therein. FIG. 10 is a front view of a beam convergence deflector 126 employed in the electron gun 120 of FIGS. 8 and 9.

Electron gun 120 is disposed in a CRT neck portion 121 and includes a plurality of cathodes, three of which are shown in FIG. 9 as elements 158*a*, 158*b* and 158*c*. Electron gun 120 further includes the combination of a $G_1$ grid, a $G_2$ grid and the facing portion from the $G_3$ grid comprising a pre-focus lens 122 for receiving energetic electrons from the cathodes and forming the electrons into a plurality of electron beams. In this embodiment, the $G_1$ and $G_2$ grids are provided with nine pairs of aligned apertures for forming nine electron beams arranged in a matrix array. The $G_1$ and $G_2$ grids thus include three upper, intermediate and lower horizontally aligned apertures. Also in this embodiment nine cathodes arranged in a three-by-three matrix are disposed in closely spaced relation to the $G_1$ grid, with the cathodes omitted from FIG. 8 for simplicity. Electron gun 120 further includes a $G_4$ grid and a $G_5$ grid, which in combination form a main focus lens 124 of the electron gun. The upper, lower and outer electron beams in the three-by-three matrix are deflected toward the longitudinal access of the electron gun within the pre-focus lens 122 causing the beams to pass through a beam crossover 123 on the electron gun's longitudinal axis. In pre-focus lens 122, the left and right beams are respectively deflected rightward and leftward while the upper and lower beams are respectively deflected downwardly and upwardly. Thus, the three upper electron beams 156*a*, 156*b* and 156*c* in the electron gun's pre-focus lens 122 are deflected downwardly prior to transit through the beam crossover 123 and the three lower electron beams 152*a*, 152*b* and 152*c* are deflected upwardly. Thus, in the electron gun's main focus lens 124, the three upper beams are 152*a*, 152*b* and 152*c*, which beams were originally the three lower beams in the electron gun's pre-focus lens 122. The left and right outer electron beams similarly interchange positions in traveling from the pre-focus lens 122 to the main focus lens 124 between which the beams pass through the beam crossover 123.

As shown in FIG. 10, beam deflector 126 includes upper and lower deflector plates 140 and 142 as well as a pair of outer deflector plates 144 and 150 and a pair of inner deflector plates 146 and 148. The electron beams are arranged in a three-by-three matrix and include a trio of upper electron beams 152*a*, 152*b* and 152*c*, a trio of intermediate electron beams 154*a*, 154*b* and 154*c*, and a trio of lower electron beams 156*a*, 156*b* and 156*c*. The various charged plates of beam deflector 126 are maintained at relative voltages as previously described with respect to the beam convergence deflector 76 shown in FIGS. 6–8. The present invention is thus not limited to a matrix array of six or nine electron beams, but is contemplated for use with virtually any number of electron beams arranged in three groups a color CRT.

Figure 11:
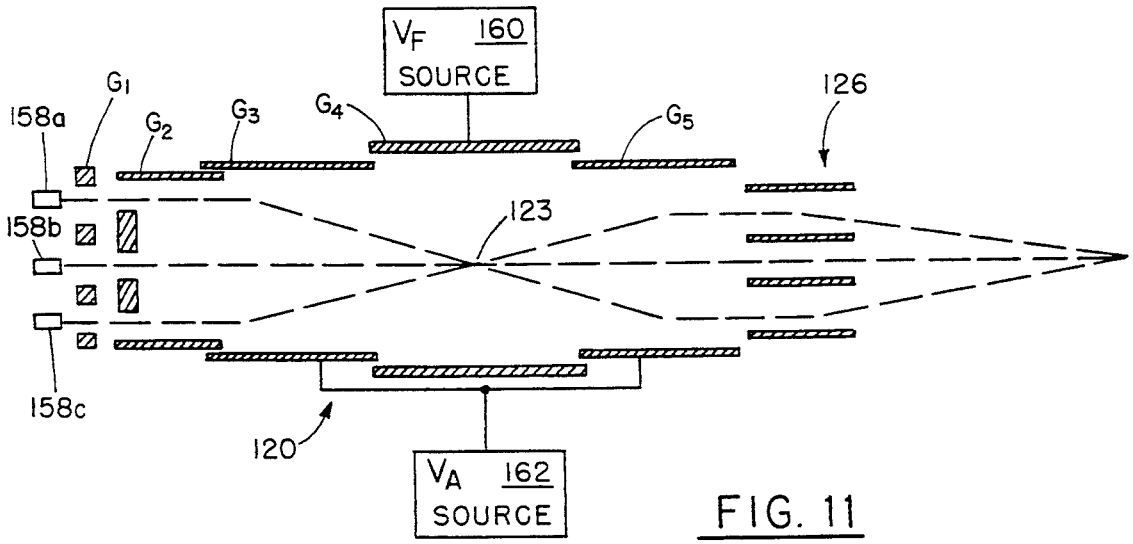
FIG. 11 is a longitudinal sectional view of the three-beam group electron gun of FIG. 8 showing the various grids of the electron gun coupled to respective voltage sources.

Referring to FIG. 11, there is shown a simplified longitudinal sectional view of electron gun 120 showing the $G_4$ grid coupled to and charged by a focus voltage ($V_F$) source 160 and the $G_3$ and $G_5$ grids coupled to and charged by an accelerate voltage ($V_A$) source 162. Thus, in the embodiment of the invention shown in FIGS. 8, 9 and 11, the electron gun 120 is of the Einzel type with a common lens for focusing the electron beams in three spaced, vertically aligned spots 132, 134 and 136 on the CRT's faceplate 128 as shown in FIG. 8. The electron beams pass through vertically aligned shadow mask apertures 138 as they horizontally scan the CRT's faceplate 128. The three upper electron beams are converged and focused on an upper electron beam spot 132, while the three intermediate and the three lower electron beams are respectively converged and focused on intermediate and lower electron beams spots 134 and 136 on the CRT's faceplate 128.

Each of the nine electron beams in electron gun 120 of FIG. 8 includes respective data for a video image presented on the CRT's display screen 128. For example, the trio of upper electron beams 152*a*, 152*b* and 152*c* respectively include red, green and blue data for that portion of the video image formed by the upper electron beam spot 132 as it is scanned across the CRT's display screen 128 in a raster-like manner. Similarly, the intermediate trio of electron beams 154*a*, 154*b* and 154*c* respectively include red, green and blue video image information for the intermediate electron beam spot 134 as it is scanned across the CRT's display screen 128. Finally, the trio of lower electron beams 156*a*, 156*b* and 156*c* respectively include red, green and blue data for that portion of the video image formed by the lower electron beam spot 136 as it is traced over the CRT's display screen 128. Therefore, each of the nine electron beams includes its own unique set of information for presentation on the CRT's display screen 128 in forming a video image thereon. The video image information in each of the nine electron beams may be provided in various ways, two of which are described in the following paragraphs.

Referring to FIG. 12, there is shown a perspective view of one embodiment of a $G_1$ control grid 228 for use in the electron gun of the present invention. The various video signal connections to the $G_1$ control grid 228 are shown in simplified block diagram form in the figure. The surface of the $G_1$ control grid 228 facing three cathodes includes three horizontally spaced coined or recessed portions 228*a*, 228*b* and 228*c* shown in dotted-line form. The three cathodes (not shown in the figure for simplicity) are each aligned with a respective vertical array of three apertures in the $G_1$ control grid 228, with each cathode providing the electron beams for one of the primary colors of red, green and blue. Disposed within the first coined portion 228*a* are three vertically aligned apertures 280*b*, 282*b* and 284*b*, where the letter "b" designates the color blue. Similarly, the center coined portion 228*b* includes three vertically aligned apertures 280*g*, 282*g* and 284*g*, where the letter "g" designates the color green. Finally, the third coined portion 228*c* includes vertically aligned apertures 280*r*, 282*r* and 284*r* where the letter "r" designates the color red.

The $G_1$ control grid 228 is comprised of a non-conductive ceramic substrate 260 having a plurality of thin conductive elements each encompassing a respective one of the beam passing apertures. Each of these conductive elements is coupled to a respective video signal source for modulating the electron beam passing through its associated aperture. Thus, the upper row of beam passing apertures 280*b*, 280*g* and 280*r* are respectively disposed in conductive portions 262, 264 and 266 on the surface of ceramic substrate 260. Similarly, each of the lower row of apertures 284*b*, 284*g* and 284*r* is disposed within a respective one of the conductive portions 269, 271 and 273. Finally, the middle row of beam passing apertures 282*b*, 282*g* and 282*r* are respectively disposed in conductive portions 275, 277 and 279. The conductive portions are formed by attaching a thin metallic layer to the surface of the ceramic substrate 260 such as by brazing or cramping. Portions of the thus attached metal layer are then removed by conventional means such as chemical etching so as to form the separated, discrete conductive portions shown in the figure. An insulating gap is thus formed between adjacent pairs of conductive portions so as to electrically isolate the conductive portions from one another. Each of the aforementioned conductive portions has essentially the same surface area so as to provide each conductive portion with essentially the same capacitance.

As shown in FIG. 12, each of the aforementioned conductive portions is coupled to and driven by a respective video signal source. Thus, the upper row of conductive portions 262, 264 and 266 are respectively coupled to $V_{1AB}$, $V_{1AG}$ and $V_{1AR}$ video signal sources 286, 288 and 290. Similarly, each of the conductive portions 269, 271 and 273 in the lower row is coupled to a respective one of the $V_{1CB}$, $V_{1CG}$ and $V_{1CR}$ video signal sources 298, 300 and 302. Finally, each of the intermediate, or center, conductive portions 275, 277 and 279 is coupled to a respective one of the video signal sources $V_{1BB}$, $V_{1BG}$ and $V_{1BR}$ video signal sources 292, 294 and 296. With each of the beam passing apertures disposed within and extending through a respective one of the conductive portions, variations in the video signals provided to each of the conductive portions allows an electron beam passing through each respective aperture to be modulated in accordance with the video image to be presented on the display screen. In this manner, the embodiment of the $G_1$ control grid 228 shown in FIG. 12 permits nine electron beams to be modulated in accordance with nine separate video signals.

Each of the aforementioned video signal sources includes a respective video memory. Thus, the $V_{1AB}$, $V_{1AG}$ and $V_{1AR}$ video signal sources 286, 288 and 290 respectively include video memories 286*a*, 288*a* and 290*a*. Similarly, the $V_{1BB}$, $V_{1BG}$ and $V_{1BR}$ video signal sources 292, 294 and 296 respectively include video memories 292*a*, 294*a* and 296*a*. Finally, the $V_{1CB}$, $V_{1CG}$ and $V_{1CR}$ video signal sources 298, 300 and 302 respectively include video memories 298*a*, 300*a* and 302*a*. Each of the video memories is adapted for storing video image data for subsequent writing to a respective one of the $G_1$ grid's conductive portions for controlling a respective one of the electron beams passing through an aperture therein. Temporary storage of data in the video memories allows the data to be read from the memories and provided to the $G_1$ grid's conductive portions such that the upper three electron beams, the intermediate three electron beams, and the lower three electron beams contain video data for adjacent scan lines forming an image on the display screen. For example, video information in a received television signal for the three upper electron beams would be stored in memory longer than the video data provided to the two lower rows of electron beams would be stored in corresponding memories because all of the electron beams simultaneously trace out a portion of a video image, with the data for the upper three beams received earlier.

Figure 13:
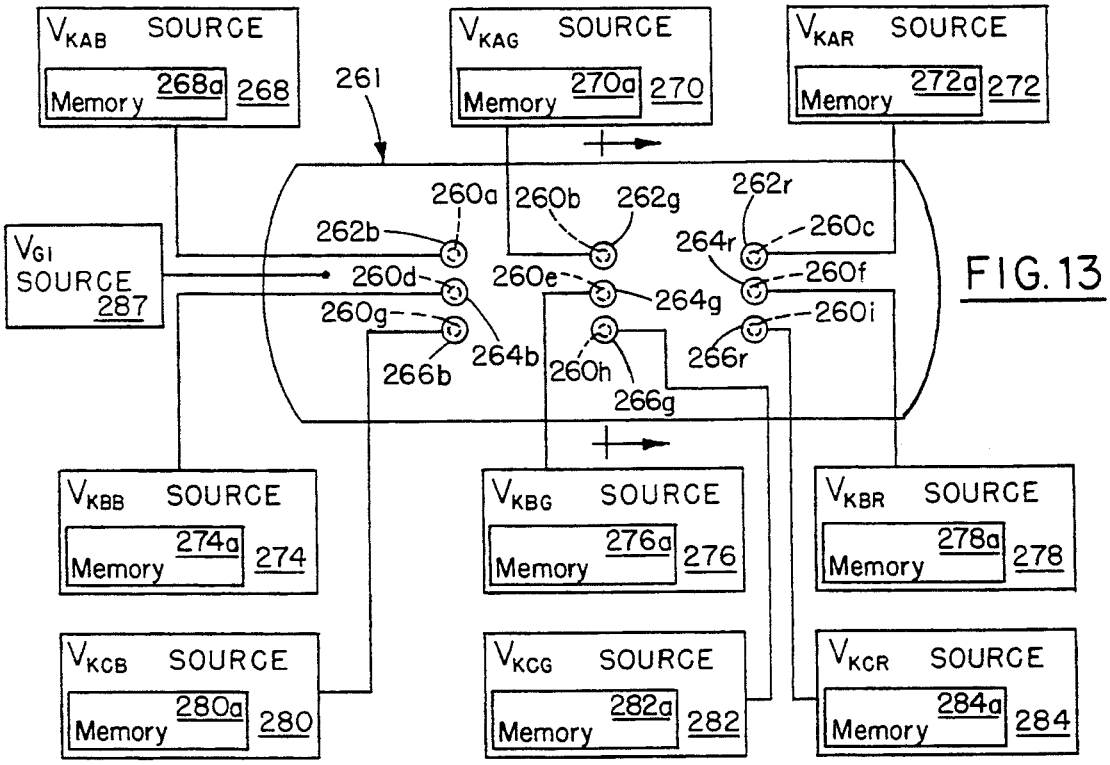
FIG. 13 is an aft elevation view of another embodiment of a cathode control arrangement including a plurality of cathodes and a $G_1$ grid combination for use in the present invention showing each of the cathodes coupled to a respective video signal source.
Figure 14:
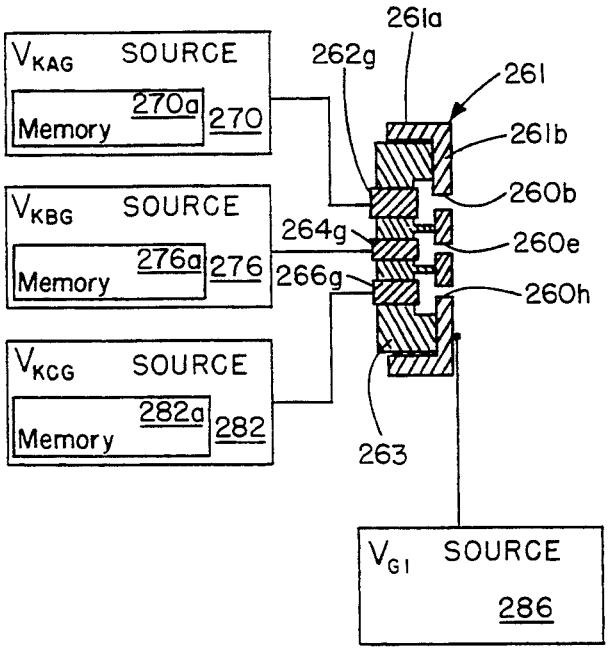
FIG. 14 is a lateral sectional view of the cathode and $G_1$ grid combination shown in FIG. 13 taken along site line 14—14 therein.

Referring to FIG. 13, there is shown an aft elevation view of another embodiment of a $G_1$ control grid 261 for use in the present invention. A lateral sectional view of the $G_1$ control grid 261 shown in FIG. 13 taken along site line 14—14 therein is shown in FIG. 14. The $G_1$ control grid 261 includes a three-by-three matrix of apertures shown in dotted-line form including an upper row of apertures 260*a*, 260*b* and 260*c*; a middle row of apertures 260*d*, 260*e* and 260*f*; and a lower row of apertures 260*g*, 260*h* and 260*i*. Disposed aft of and adjacent to each of the aforementioned apertures is a respective cathode. Thus, an upper row of cathodes 262*b*, 262*g* and 262*r* are respectively disposed aft of and adjacent to apertures 260*a*, 260*b* and 260*c*. Similarly, a middle row of cathodes 264*b*, 264*g* and 264*r* are respectively disposed immediately aft of apertures 260*d*, 260*e* and 260*f*. Finally, a lower row of cathodes 266*b*, 266*g* and 266*r* are respectively disposed immediately aft of apertures 260*g*, 260*h* and 260*i*. The $G_1$ control grid 261 includes a generally flat end wall 261*b* containing the matrix of apertures and a side wall 261*a* extending about the periphery of the end wall. Disposed within the end wall 261*b* and including a plurality of spaced apertures for receiving and supporting each of the cathodes is an insulating ceramic substrate 263. The $G_1$ control grid 261 is preferably comprised of a conductive metal and is biased by a $V_{G1}$ voltage source 287. Each of the cathodes when heated generates a respective plurality of energetic electrons which are directed through an adjacent aperture in the $G_1$ control grid 261. In this manner, nine spaced electron beams arranged in a three-by-three matrix are formed by the $G_1$ control grid 261 and are directed toward a $G_2$ screen grid in the electron gun which is not shown in the figures for simplicity.

Each of the cathodes is coupled to and energized by a respective video signal source. Thus, the upper row cathodes 262*b*, 262*g* and 262*r* are respectively coupled to $V_{KAB}$, $V_{KAG}$ and $V_{KAR}$ video signal sources 268, 270 and 272. Similarly, each of the middle row cathodes 264*b*, 264*g* and 264*r* is respectively coupled to $V_{KBB}$, $V_{KBG}$ and $V_{KBR}$ video signal sources 274, 276 and 278. Finally, each of the lower row cathodes 266*b*, 266*g* and 266*r* is respectively coupled to $V_{KCB}$, $V_{KCG}$ and $V_{KCR}$ video signal sources 280, 282 and 284. Each of the video signal sources provides a modulating signal to its associated cathode for controlling the electrons emitted by the cathode and the resulting video image formed by the electron beam. Each of the video signal sources includes a respective memory for storing video data which is read from the video memory and provided to an associated cathode. Thus, the $V_{KAB}$, $V_{KAG}$ and $V_{KAR}$ video signal sources 268, 270 and 272 respectively include video memories 268*a*, 270*a* and 272*a*. Video signal sources $V_{KBB}$, $V_{KBG}$ and $V_{KBR}$ 274, 276 and 278 respectively include video memories 274*a*, 276*a* and 278*a*. Finally, video signal sources $V_{KCB}$, $V_{KCG}$ and $V_{KCR}$ 280, 282 and 284 respectively include video memories 280*a*, 282*a* and 284*a*. Video memories allow the video signal sources associated with different horizontal scan lines to temporarily store video data, such as in a received television signal, for subsequent recall and simultaneous display with video data associated with adjacent horizontal scan lines.

There has thus been shown a multi-beam group electron gun for a color CRT which includes a plurality of vertically spaced, horizontal inline electron beams which are arranged in a matrix array. Each horizontal array of beams provides the three primary colors of red, green and blue and are converged on a common spot on the display screen with the electron beam spots in vertical alignment. Adjacent vertically aligned electron beam spots simultaneously trace adjacent horizontal scan lines on the CRT's display screen. All of the beams are deflected in unison across the screen. Each electron beam is modulated in accordance with that portion of the video image which it forms allowing adjacent, vertically spaced, horizontal inline arrays of beams to write different video image information on the screen in simultaneously forming adjacent portions of the video image. The multi-beam group electron gun is of the common lens type wherein all of the electron beams pass through and are focused by a common lens. The common lens may be of the Einzel type with all of beams converged to a cross over on the electron gun's axis at the center of the Einzel lens, with the diverging beams then directed through a convergence arrangement which converges each group of the horizontally aligned beams to a common spot on a given scan line permitting video image information to be presented simultaneously on more than one scan line. The beam convergence arrangement equalizes the vertical and horizontal convergence effects on each of the beams in the matrix array of beams to deflect the outer beams inwardly while deflecting the upper and lower beams respectively downwardly and upwardly so that each group of horizontally aligned beams converge on the center beam of that group to provide vertically aligned, spaced electron beam spots on the display screen. The individual electron beams may be modulated by providing video signals to each of a plurality of conductive portions each containing a beam passing aperture in the $G_1$ control grid or to individual cathodes each aligned with a respective aperture in the $G_1$ control grid. Simultaneously providing video information on more than one horizontal scan line allows for a reduction in horizontal scan frequency and associated magnetic deflection yoke operating criteria. Reducing the scan rate of the electron beams also increases beam dwell time on the screen's phosphor elements allowing for a reduction in beam current density without sacrificing video image brightness while improving video image resolution.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. An electron gun for a multi-beam color cathode ray tube (CRT) including a display screen whereon a video image is formed by sweeping a plurality of horizontally aligned electron beams over a plurality of vertically spaced, horizontal scan lines in a raster-like manner, wherein each electron beam provides one of the three primary colors of red, green or blue of the video image, said electron gun including a high voltage common focus lens for focusing the electron beams on said display screen, the electron gun comprising:

cathode means for providing energetic electrons;

beam forming means disposed intermediate the cathode means and said common focus lens for forming said energetic electrons into a plurality of beams, said beam forming means including first and second spaced, charged grids respectively having first and second arrays of spaced apertures for forming the energetic electrons into a plurality of beams, wherein each of said first and second arrays of apertures include upper and lower horizontally aligned apertures for passing horizontally aligned electron beams providing the three primary colors of red, green and blue for upper and lower horizontal scan lines, respectively, and wherein the apertures in said first and second arrays are further grouped in vertical alignment so as to form vertically grouped electron beams with the electron beams in each vertical group providing one of the primary colors on a respective horizontal scan line; and convergence means disposed intermediate said common focus lens and the display screen for converging the electron beams into an upper and a lower spot on the display screen, wherein the upper and lower spots are swept over adjacent upper and lower horizontal scan lines, respectively.

2. The electron gun of claim 1 wherein said convergence means includes a plurality of charged, generally planar plates disposed about and intermediate said electron beams.

3. The electron gun of claim 2 wherein said plurality of plates includes a plurality of horizontally spaced, vertically aligned plates and a pair of vertically spaced, horizontally aligned plates respectively disposed above and below said plurality of horizontally spaced, vertically aligned plates.

4. The electron gun of claim 3 wherein each of said pair of vertically spaced, horizontally aligned plates includes a respective slot in an edge thereof for providing an essentially equal convergence for all of said electron beams.

5. The electron gun of claim 4 wherein the edges of said pair of vertically spaced, horizontally aligned plates including said slots are in facing relation to said common focus lens.

6. The electron gun of claim 5 including first and second opposed, vertically aligned outer arrays of electron beams and a vertically aligned inner array of electron beams, wherein said inner array of electron beams is disposed intermediate the respective slots in said pair of vertically spaced, horizontally aligned plates.

7. The electron gun of claim 6 including four horizontally spaced, vertically aligned plates including two inner and two outer plates, wherein each vertical group of electron beams passes intermediate adjacent horizontally spaced, vertically aligned plates.

8. The electron gun of claim 7 wherein said inner plates are charged to a voltage $V_1$, said outer plates are charged to a voltage $V_2$, and said vertically spaced, horizontally aligned plates are charged to a voltage $V_3$, where $V_1$ and $V_2$ are greater than $V_3$ and $V_1-V_3$ is greater than $V_2-V_3$.

9. The electron gun of claim 1 wherein said first and second arrays of apertures include three pairs of vertically aligned grouped apertures for passing first and second vertically aligned electron beams for each of the primary colors of red, green and blue.

10. The electron gun of claim 9 wherein said first grid includes a plurality of first and second vertically spaced, horizontally aligned charged portions each including a respective aperture of said first array of apertures and having essentially equal capacitance.

11. The electron gun of claim 10 wherein said first grid further includes a non-conductive portion disposed intermediate said plurality of charged portions.

12. The electron gun of claim 11 wherein said charged portions are comprised of metal and said non-conductive portion includes means for defining a gap between adjacent conductive portions.

13. The electron gun of claim 12 further comprising a first plurality of video signal sources each coupled to a respective one of said first charged portions of said first grid and a second plurality of video signal sources each coupled to a respective one of said second charged portions of said first grid for providing respective video signals thereto.

14. The electron gun of claim 13 wherein each of said first and second pluralities of video signal sources includes memory means for storing a received video signal for subsequent display on the display screen by said electron beams.

15. The electron gun of claim 14 wherein said common focus lens is an Einzel lens.

16. The electron gun of claim 15 wherein said beam forming means includes a $G_1$ control grid and a $G_2$ screen grid.

17. The electron gun of claim 16 wherein common focus lens includes $G_3$, $G_4$, and $G_5$ charged grids.

18. The electron gun of claim 9 wherein said cathode means includes a plurality of cathodes including a first upper array of horizontally aligned, spaced cathodes and a second lower array of horizontally aligned, spaced cathodes, wherein each cathode is aligned with respective aligned apertures in said first and second grids.

19. The apparatus of claim 18 further comprising a plurality of video signal sources each respectively coupled to a respective one of said cathodes for providing a respective video signal thereto.

20. The electron gun of claim 19 wherein each of said video signal sources include memory means for storing a received video signal for subsequent display on the display screen by a corresponding electron beam.

21. The electron gun of claim 20 wherein said first and second charged grids are a $G_1$ control grid and a $G_2$ screen grid, respectively.

22. For use in a color cathode ray tube (CRT) wherein a plurality of electron beams are directed onto a display screen of said CRT for forming a video image thereon, said CRT including a common lens electron gun for directing said electron beams in an $M \times N$ matrix toward said display screen, apparatus for converging said electron beams on said display screen comprising:

a pair of upper and lower charged plates in vertical alignment and disposed intermediate the electron gun and the display screen, wherein the electron beams pass intermediate said pair of upper and lower charged plates and wherein said upper and lower charged plates are maintained at a voltage $V_3$;

a pair of horizontally spaced outer charged plates disposed intermediate said upper and lower charged plates and maintained at a voltage $V_2$; and a pair of horizontally spaced inner charged plates disposed intermediate said pair of outer charged plates and said pair of upper and lower charged plates and maintained at a voltage $V_1$, wherein a plurality of vertically aligned electron beams are directed intermediate said pair of horizontally spaced inner charged plates and intermediate adjacent inner and outer charged plates, whereby said electron beams are converged on the display screen of the CRT in the form of a plurality of vertically aligned spots, and wherein each electron spot is incident on a respective vertically spaced horizontal scan line of the display screen.

23. The apparatus of claim 22 wherein each of said charged plates is generally planar and wherein said upper and lower plates are horizontally aligned and said inner and outer plates are vertically aligned.

24. The apparatus of claim 23 wherein $V_1$ and $V_2 > V_3$ and $V_1 - V_3 > V_2 - V_3$.

25. The apparatus of claim 24 wherein each of said upper and lower charged plates includes a respective slot in an edge thereof for providing an essentially equal electrostatic vertical convergence field for all of said electron beams.

26. The apparatus of claim 25 wherein said slots in said upper and lower charged plates are in respective edges thereof in facing relation with said electron gun.

27. The apparatus of claim 26 wherein said common lens is an Einzel lens.

* * * * *

UNITED STATES PATENT AND TRADEMARK OFFICE

CERTIFICATE OF CORRECTION

PATENT NO. : 5,382,883

DATED : January 17, 1995

INVENTOR(S) : Hsing-Yao Chen and Chun-Hsien Yeh

It is certified that error appears in the above-indentified patent and that said Letters Patent is hereby corrected as shown below:

On the front page of the patent, at [75] change "Prov. of China" to --Republic of China--.

On the front page of the patent, at [73] change "Prov. of China" to --Republic of China--.

Signed and Sealed this

Fifth Day of September, 1995

*Attest:*

*Attesting Officer*

Bruce Lehman

BRUCE LEHMAN

*Commissioner of Patents and Trademarks*